United States Patent [19]

Nogueira et al.

[11] 4,290,863

[45] * Sep. 22, 1981

[54] PROCESS FOR ELECTROLYSIS OF BRINE BY MERCURY CATHODES

[76] Inventors: Eduardo D. Nogueira, Avda, Mediterraneo 47; Luis Alonso S. Infanzon, Avda, Valladolid 73; Enrique H. Tezanos, Aniceto Marinas 110, all of Madrid, Spain

[ * ] Notice: The portion of the term of this patent subsequent to Jun. 24, 1997, has been disclaimed.

[21] Appl. No.: 104,829

[22] Filed: Dec. 18, 1979

Related U.S. Application Data

[63] Continuation-in-part of Ser. No. 840,224, Oct. 7, 1977, Pat. No. 4,209,370.

[30] Foreign Application Priority Data

Oct. 8, 1976 [ES] Spain ..... 452.238

[51] Int. Cl.[3] ..... C25B 1/38

[52] U.S. Cl. ..... 204/99; 204/128

[58] Field of Search ..... 204/98, 128, 99, 251, 204/282, 283

[56] References Cited

U.S. PATENT DOCUMENTS

| | | | |
|---|---|---|---|
| 4,035,254 | 7/1977 | Gritzner | 204/98 |
| 4,100,050 | 7/1978 | Cook et al. | 204/98 |
| 4,209,370 | 6/1980 | Nogueira et al. | 204/99 |

*Primary Examiner*—R. L. Andrews

*Attorney, Agent, or Firm*—Friedman, Goodman & Teitelbaum

[57] ABSTRACT

An electrolysis process for chlorine-caustic production using a mobile film of mercury as the cathode, and a cation permeable membrane to separate the electrodes, the film of mercury continuously flowing across one side of the membrane. The membrane is impervious to the passage of the mercury therethrough for preventing short circuits between the mercury cathode and the anode, the anode being preferably a grid. The membrane is disposed against the anode to avoid breakage of the membrane due to the pressure of the film of mercury. Preferably, the membrane is positioned in a vertical arrangement and the film of mercury flows in an upward direction across the membrane. Anolyte and cathode sections of the electrolytic cell may be stacked in a matching alternating side-by-side arrangement with each of the sections being bifrontal.

7 Claims, 2 Drawing Figures

PROCESS FOR ELECTROLYSIS OF BRINE BY MERCURY CATHODES

Figure 1:
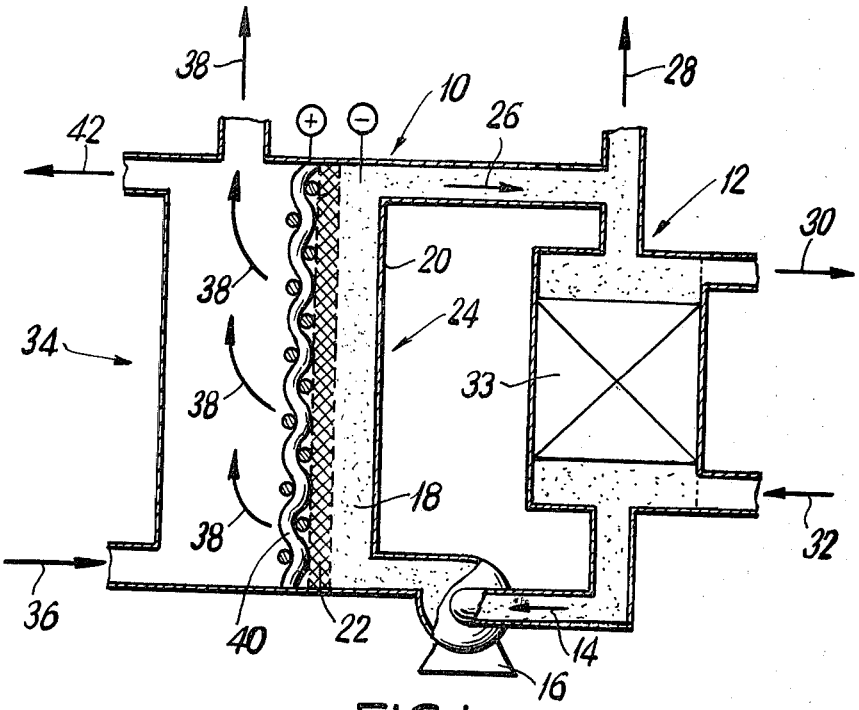

This application is a continuation-in-part application of Ser. No. 840,224, filed on Oct. 7, 1977, now U.S. Pat. No. 4,209,370, for a "PROCESS FOR ELECTROLYSIS OF BRINE BY MERCURY CATHODES" by the same inventors. All the information contained in the aforereferrenced application is herein incorporated by reference.

This invention relates to an electrolysis process for producing chlorine and a sodium amalgam from brine, the sodium amalgam being continuously drawn from the cell and decomposed to caustic soda and free mercury in a device external to the cell, in such a way that the free mercury is fed back to the cell. The present invention combines the mercury cathode and a cation permeable membrane in such a way that its combination enhances the particular performance of both components.

It is well known that mercury cells for brine electrolysis and chlorine production have been widely used since the late years of the 19th century. Profiting from the high hydrogen overvoltage of mercury, mercury cathodes were used to produce an amalgam that could be separated from the brine and decomposed with water to a concentrated solution of caustic soda. The mercury was regenerated and pumped back to the electrolytic cell to provide a closed system.

This type of cell showed from the beginning of its operation, in competition with the other widely used diaphragm cell, a greater current efficiency, a high purity of the caustic solution substantially free of salt, and reduced energy costs. In spite of higher electricity costs than the diaphragm cell, the mercury cell's direct production of concentrated caustic solution, without evaporation or concentration which is typical of the diaphragm cell, makes its total energy consumption lower than the diaphragm cell, which constitutes the main attractiveness of these mercury cells.

Ordinary mercury cells, however, have a characteristic set-back which is derived from the necessity of using horizontal cathodes which was required by the liquid mercury. For example, large floor spaces are required and delicate mechanizing of the base plate is needed to get an electrodic surface that is proportional to the desired production capacity. This inconvenience is overcome by placing the mercury film in vertical position, in such a way that a great number of such vertical films could be stacked together into a small floor area.

This vertically positioned mercury film has originated several inventions. Most of them solve the problem of the vertical mercury film by having it fall down from the upper part of the cell, wetting a steel grid. See U.S. Pat. Nos. 2,829,096, 3,065,163 and 3,398,080. Some, such as in U.S. Pat. No. 4,107,020, have tiny streams of mercury falling down from precisely drawn holes. In every case, the inventions recognize the need of avoiding any accidental spillage to the closely facing anode, and therefore place a diaphragm or membrane between them to stop the occasional droplets of mercury.

This type of cell operates with a rather high voltage, due to the necessarily great separation between both electrodes, and with problems derivating from the variation of the fluid characteristics of the mercury through the cell, due to the different viscosity, wetting capacity and density of the amalgam and the mercury. Furthermore, it is well known that undesired solid forms, called "butter", are formed by the combination of mercury and impurities from the brine, that alterates the handling of the mercury stream. These inconveniences affects also the inventions where mercury is contained by a membrane, such as in U.S. Pat. Nos. 3,775,272, 3,864,226 and 4,046,654.

The cell of the present invention overcomes all the above inconveniences through the combination of the mercury and a cation permeable membrane that has a porous structure such that it does not allow the mercury to pass through it. Thus, the membrane may hold the mercury in such manner that no short-circuiting between anode and cathode is possible, while keeping the interelectrodic distance as small as the membrane thickness, and solving any problem deriving from the "butter" formation.

Figure 2:
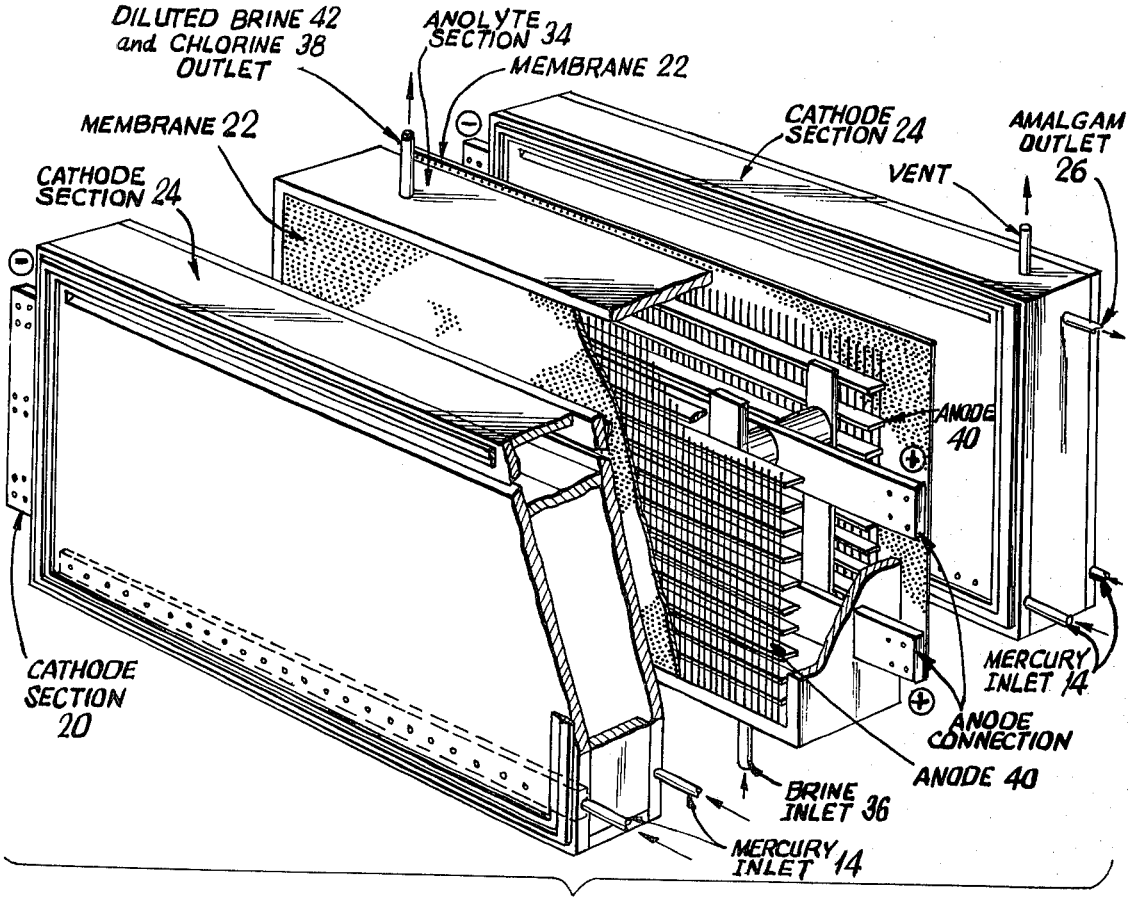

In the Drawings:

FIG. 1 schematically shows an electrolytic cell according to the present invention; and FIG. 2 is a perspective view of a preferred embodiment of the electrolytic cell of the present invention.

Referring now to FIG. 1, the electrolytic cell 10 of the present invention is schematically shown in an upright position at the left side thereof, and a conventional deamalgamating unit 12 is disposed at the right side thereof.

The mercury 14 is continuously pumped by the pump 16 into the lower part of the cathodic space 18 provided between the steel plate 20 where the negative pole of the current is connected, and the membrane 22. The thickness of this cathodic space 18 can vary with the specific design of the cathode section 24, but a typical value will be 4 mm. The film of mercury in the cathode space is the cathode.

The mercury 14 flows upward inside this space 18, receiving sodium (Na+) ions from the anolyte. The sodium ions gradually convert into a fluid amalgam 26 that, due to its lower density than mercury, flows upward too. The amalgam 26 is drawn continuously from the upper outlet of the cell 10, and fed to the conventional deamalgamation unit 12 or "denuder", where hydrogen 28 and caustic soda 30 (NaOH, 50% W) are formed by reaction with water 32 (deionized) catalyzed by a special bed of active graphite 33 disposed in the deamalgamation unit 12. The mercury 14 is regenerated to have a very low concentration of sodium and is pumped back to the cell 10. Thus, the film of mercury 14 continuously removes the amalgam 26 which is formed in the cathodic space 18 of the cathode section 24 of the electrolytic cell 10.

In the anolyte section 34 of the cell 10, the brine 36 (concentrated brine 26% W) defining the anolyte is continuously fed therein, being electrolyzed into chlorine and sodium ions. The sodium ions travel through the membrane into the mercury cathode 14. The chlorine gas 38 evolves from the anode 40, and the partially depleted brine 42 (diluted brine 13–15% W) goes out through the upper part of the cell 10, into a resaturation section or waste disposal (not shown), dpending on the economy of the cell 10.

The mercury 14 is restricted by the membrane 22 which divides or separates the anolyte section 34 from the cathode section 24. The membrane's pore size does not allow the passage of mercury therethrough, unless a very high pressure exists. The relationship between pore size and pressure is regulated by a well known equation:

$$\text{Diameter of pore} \leq \frac{1.5 \times 10^{-1}}{\Delta P} \text{ mm}$$

where the maximum allowable pore diameter, in mm, is deduced from the difference in hydrostatic pressure, ΔP, in Newton per square centimeter (N $cm^{-2}$) between anode and cathode. Thus, the porous membrane 22 is impervious to the passage of the mercury 14, thus preventing any short circuits between the anode and cathode poles of the cell 10, but the porous membrane 22 is pervious to the passage of the above mentioned ions therethrough.

Most of the commercial Nafion membranes, available from E. I. DuPont, have a pore diameter size less than this value and, thus, they are applicable to this invention, the value for ΔP being in the order of 10–20 N $cm^{-2}$.

The pressure, which the mercury 14 exerts over the membrane surface, bends and eventually will break the membrane 22 unless it is compensated by some mechanical structure that supports the membrane position. This mechanical structure is provided by the grid or grill of the anode 40, that thus fulfills a dual function as an electrical anode and as a support for the membrane.

The interelectrodic distance between the anode and cathode is thus reduced exclusively to the membrane thickness, being as low as 0.1 mm in some cases. This reduced distance reduces the voltage drop and energy costs, consequently, to very low values. Besides, with the membrane being continuously tightened into a fixed position between the mercury cathode and the anode, the membrane does not suffer from fatigue stress, and therefore allows for longer operating periods than those usually obtained in membrane cells.

The vertical position of the anode 40 makes the evolving chloride gas bubbles a cleaning agent that continuously maintains a turbulence condition in the vicinity of the anode to clean same, thus diminishes the overvoltage in operation to low values.

Furthermore, this type of cell may operate with greater brine depletion than other types of chlorine producing cells without risk of explosion, which risk is present in standard mercury cells, due to the membrane separation of anode gases (chlorine and oxygen) and cathode gas (hydrogen). The high current efficiency, due to the lack of concentrated caustic soda at the cathode, is also greater than diaphragm and membrane cells, at any brine depletion.

As shown in FIG. 1, the mercury cathode 14 and the brine anolyte 36, 42 circulate through the cell 10 in counter currents or flows, the mercury flowing in a clock-wise direction and the brine flowing in a counter clock-wise direction. However, adjacent the membrane 22, both the mercury and the brine flow upwards in the same direction on opposite sides of the membrane 22.

FIG. 2 shows a preferred embodiment of the present invention, wherein a series of electrolytic cells are repeatedly stacked in a side-by-side arrangement to constitute an industrial electrolyzer. A bifrontal anolyte section 34 is disposed between two bifrontal cathode sections 24. The anolyte section 34 includes one membrane 22 disposed on each opposite front side thereof, having an anode 40 and an anode connection for each of the two membranes 22. An inlet is provided for the brine 36, and a single outlet is provided for the diluted brine 42 and chlorine 38.

Each cathode section 24 includes a cathode connection 20 defined by the above mentioned steel plate, two inlets for the mercury 14, and an outlet for the amalgam 26. Additionally, a vent is provided in each cathode section 24 to permit gases formed therein to egress therefrom. Thus, any preferred number of anolyte and cathode matching sections can be alternately stacked together as required for producing a specific amount of chlorine. The following four examples are set forth to demonstrate the present invention.

EXAMPLE 1.

A cell has been constructed as shown in FIG. 1, with a circular section for the electrodes having a 77 mm diameter, and a 46 $cm^2$ surface area. Brine with a concentration of 300 g/l was fed continuously as the anolyte, and the mercury was the cathode. A Nafion #120 membrane, a commercial product from E. I. DuPont, and a dimensionally stable anode were used. The chlorine evolved from the anode, and the amalgam from the cathode, the latter being continuously regenerated to mercury using the above mentioned "denuder". Flows of the streams were:

Brine: 3 l/h

Mercury: 11.31 kg/h or 0.84 l/h.

In this condition, a voltage of 3.8 V was applied to the cell, with a current intensity of 13.5 Amperes and a continuous flow of chlorine was produced, with 98% current efficiency, at 70° C.

EXAMPLE 2

The same experimental procedure mentioned in Example No. 1 was employed, but operating at 90° C. A voltage of 3.7 V. was now only needed for the above 13.5 A current, while obtaining the same 98% current efficiency mentioned previously.

EXAMPLE 3.

A cell similar to that shown in FIG. 2, with four electrodic planes of membrane, each 50 cm high ×25 cm wide, totaling 0.5 $m^2$ of Nafion #120 membrane surface, was fed with 30 l/h of 280 g/l brine and 850 l/h of mercury. A current density of 3 $KA/m^2$ was established, applying 3.8 V at 80°. Chlorine was continuously produced with a purity of 99.8% and a measured current efficiency of 98.5%.

EXAMPLE 4

The same experimental procedure mentioned in Example No. 3, but using Nafion #114 membrane, which has a lower equivalent weight and is thinner than Nafion #120, led to the production of chlorine with 98% current efficiency, at 1500 Amperes of current intensity but only 3.65 V at 80° C. Over 1000 hours of continuous operation did not change these operating conditions significantly.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A process for electrolysis of brine by a mercury cathode, said process comprising:

providing an electrolytic cell;

dividing said cell into an anolyte section for discharge of chlorine and a cathode section by disposing a membrane in said cell;

providing an anode in said anolyte section;

employing a film of mercury in said cathode section as the cathode, and employing the brine in said anolyte section as an anolyte;

continuously flowing said film of mercury across one side of said membrane, and continuously flowing said brine across an opposite side of said membrane;

positioning said membrane against said anode of said anolyte section to avoid breakage of said membrane due to pressure of said film of mercury;

providing said membrane with porous means impervious to passage of the mercury therethrough for preventing short circuits between said anode and said mercury cathode of said cell, said porous means being pervious to passage therethrough of ions electrolyzed from the brine; and using said film of mercury to continuously remove an amalgam from said cathode section, said amalgam being converted from said ions in said cathode section.

2. A process according to claim 1, including providing said membrane porous means with pores, diameter of each pore being in accordance with the equation:

$$\text{pore diameter (in mm)} \lesssim \frac{1.5 \times 10^{-1}}{\Delta P}$$

where $\Delta P$ is hydrostatic pressure difference between the mercury cathode and the anode, expressed in Newtons per square centimeter ($N\ cm^{-2}$).

3. A process according to claim 1, including positioning said membrane in a vertical arrangement and directing the flow of said film of mercury in a vertical direction across said membrane.

4. A process according to claim 3, including directing the flow of said film of mercury in an upward direction across said membrane.

5. A process according to claim 1, including forming said anode as a grid.

6. A process according to claim 1, including flowing said film of mercury and said brine in the same direction across opposite sides of said membrane.

7. A process according to claim 1, including stacking a preferred number of said anolyte and cathode sections in a matching alternating side-by-side arrangement where each of said sections are bifrontal.

* * * * *